United States Patent [19]

Hartvig et al.

[11] 4,394,168

[45] Jul. 19, 1983

[54] AUSTENITIC WEAR RESISTANT STEEL

[75] Inventors: Tor Hartvig; Petter Fjellheim, both of Raufoss, Norway

[73] Assignee: A/S Raufoss Ammunisjonsfabrikker, Raufoss, Norway

[21] Appl. No.: 230,630

[22] Filed: Feb. 2, 1981

[30] Foreign Application Priority Data

Jul. 7, 1980 [NO] Norway ..... 802044

[51] Int. Cl.[3] ..... C22C 38/38

[52] U.S. Cl. ..... 75/126 A; 75/125; 75/126 B; 75/128 A

[58] Field of Search ..... 75/126 B, 126 A, 128 A, 75/125

[56] References Cited

U.S. PATENT DOCUMENTS 4,130,418 12/1978 Hartvig ..... 75/126 B

*Primary Examiner*—R. Dean

*Attorney, Agent, or Firm*—Holman & Stern

[57] ABSTRACT

Austenitic steel having 16–25% Mn, 1,1–2,0% C, 0,2–2,0% Si, 0,5–5% Cr, 0,1–0,5% Ti, 0,3–4,0% Mo with or without addition of up to 0,5% of one or more of Ce, Sn and carbide forming elements like V, W, Nb (Cb), max. 5% Ni and max. 5% Cu, the remainder being Fe and impurities to max. 0,1% P and 0,1% S.

9 Claims, 2 Drawing Figures

ALLOY 18 ROUNDED CARBIDES 100x

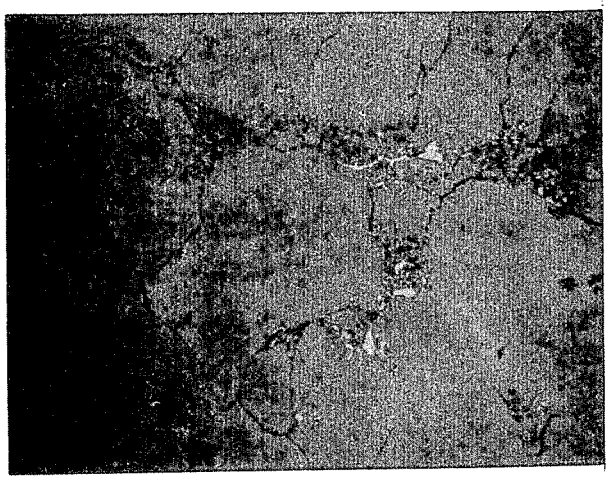
FIG. 1 TYPICAL CARBIDES IN ALLOY 4 100x
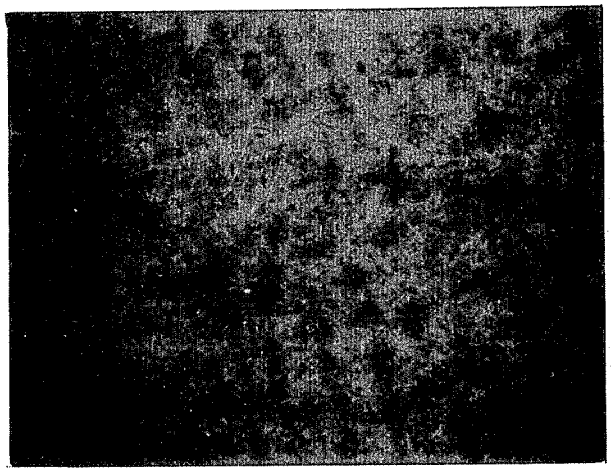
FIG. 2 ALLOY 18 ROUNDED CARBIDES 100x

AUSTENITIC WEAR RESISTANT STEEL

The invention relates to a new type of austenitic wear resistant steel.

The objective of the invention is to increase the resistance of the steel to abrasive and/or gouging wear, combined with sufficient ductility to avoid service cracking in the various applications of the steel, like bowls, mantles and concaves for cone crushers, were plates for jaw crushers, railcrossings etc., compared to the well known Hadfield Steel with 11–14% Mn, and also compared to the steel described in U.S. Pat. No. 4,130,418 containing 16–23% Mn, 1,1–1,5% C, 0–4% Cr, 0,1–0,5% Ti. (As used herein, commas and periods are frequently transposed in accordance with European usage. Thus, the U.S. patent is 4,130,419 and the percentage of Ti is 0.1–0.5%.)

The invention is characterized in that the new austenitic steel has the following chemical composition:

| | |
|---|---|
| 16–25% | Mn |
| 1,0–2,0% | C |
| 0,5–5% | Cr |
| 0,2–2,0% | Si |
| 0,1–0,5% | Ti |
| 0,3–4,0% | Mo |

0439416900405 d

In addition to this the following elements may be added for a further increase in wear resistance in amounts depending upon the actual requirements for ductility by the various applications:

0,5% of one or more of the elements: Ce, V, Nb (Cb), Sn, W max 5% Ni and max 5% Cu or other carbide forming elements. The remainder being Fe and impurities to max. 0,1% P and 0,1% S.

In the previously known austenitic wear resistant steels as referred to above, an increases of Carbon content above about 1,5% C will decrease the ductility of the material to an extent that its brittleness will make it unsuitable for many of the highly stressed applications.

The reason for this is that although a higher carbon content normally increase the wear resistance of these steels, the carbides formed during solidification and cooling precipitate preferably along and around the grain boundaries and are difficult to dissolve during the heat treatment process. Such grain boundary carbides have a pronounced embrittling effect on the material.

By adding Molybdenum to a high Manganese steel containing Titanium and Chromium and other carbide forming elements, the invention has shown the unexpected effect that the carbon content can be increased above 1.5% C and the wear resistance considerably increased without extensive embrittling of the material and without introducing complicated heat treatment processes.

The main reason for this phenomenon seems to be that when carbides are present in this type of steel, they will occur in the microstructure mainly as rounded globules of complex and hard carbides in a ductile austenitic matrix.

Such rounded carbides, occuring mainly inside the grains and to a far less extent at the grain boundaries, will in both places act as far less embrittling than the normal grain boundary carbide films, pearlite and acicular carbides. These rounded carbides however, seems ideal for improving wear resistance of the material.

Such a steel containing Molybdenum in addition to the high Manganese content and Titanium and Chromium addition, makes it possible to add higher amounts of Carbon, of each single element and of the total sum of carbide forming elements, than previously practically applicable, also with greater flexibility in the relative contents of each of these elements.

In order to demonstrate the abrasive wear resistance of the new alloy in more detail, some experimental test results are given in the following table:

TABLE 1

Chemical composition (percent by weight) of various samples of the new alloy, and steel according to U.S. Pat. No. 4.130.418 (51,58 and 4). Alloy 4 is used as reference.

| Alloy No. | % C | % Mn | % Si | % Ti | % Cr | % Mo |
|---|---|---|---|---|---|---|
| 4 | 1,4 | 19,5 | 0,47 | 0,1 | 2,5 | — |
| 51 | 1,4 | 18,0 | 0,70 | 0,1 | 2,4 | — |
| 58 | 1,5 | 22,0 | 0,63 | 0,1 | 3,2 | — |
| 17 | 1,6 | 19,4 | 0,65 | 0,1 | 2,3 | 1,1 |
| 18 | 1,6 | 19,6 | 0,51 | 0,3 | 2,3 | 1,7 |
| 19 | 1,6 | 19,5 | 0,51 | 0,3 | 2,3 | 2,0 |
| 20 | 1,8 | 19,2 | 0,51 | 0,3 | 2,3 | 2,0 |
| 21 | 1,8 | 19,5 | 0,48 | 0,1 | 3,5 | 2,7 |
| 22 | 1,9 | 19,0 | 0,43 | 0,1 | 3,6 | 2,7 |

In order to evaluate the new alloy's resistance to wear resulting from combined impact and abrasion, tests were carried out in a pan machine, using rounded stones. Test pins are moving through a mass of stones and weight loss versus time is recorded. The test pins investigated had the dimensions and were heat treated at about 1100° C. before testing.

Normalized wear ratings

The normalized wear ratings are obtained by dividing the amount of wear on the test samples by the amount of wear on the reference material (alloy No. 4) at the same wear level.

| Alloy No. | Normalized wear ratings. |
|---|---|
| 4 | 1,00 |
| 51 | 1,01 |
| 58 | 1,02 |
| 17 | 0,88 |
| 18 | 0,85 |
| 19 | 0,86 |
| 20 | 0,81 |
| 21 | 0,80 |
| 22 | 0,76 |

The microstructure of pin test from alloy No. 18 is shown in FIG. 2 as example on how the carbides that remain in the structure has a rounded globular form and are found mostly inside the grains as compared to FIG. 1 showing the typical distribution of carbides when they are present in previously known austenitic wear resistant steel of type, Hadfield or alloys 51, 58 and 4 in table 1 (according to U.S. Pat. No. 4,130,418). It can be seen from these results that the addition of Molybdenum considerably improves the wear resistance and the shape of remaining carbides in the structure. The shape and amount of carbides in the structure and the austenitic grain size varies with the composition, size of casting and heat treatment parameters.

The above results show that a steel according to U.S. Pat. No. 4,130,418 (alloy 51, 58, 4) is worn about 15–35% faster than the alloys 17–22 which are alloys within the newly invented type of steel. This unexpected effect is probably based on the rounded shape of the carbides promoted by Mo-addition, permitting higher total carbon content in the alloy for practical purposes.

As previously known, the Hadfield types of steel alloys (11–14% Mn) have a wear rate approximately 25–40% higher than steels according to U.S. Pat. No. 4,130,418, consequently conventional types of Hadfield steels will wear about 45–80% faster than this newly invented steel alloy.

Further improvement of the wear resistance seems possible but the ductility is gradually reduced when the amount of Carbon and carbide forming elements are increased. Therefore the various actual service stresses and applications of the material will be decisive for how much can practically be added of these elements, and consequently also the maximum achievable improvement of wear resistance.

The steel can be produced by conventional methods similar to Mn 12 Hadfield steel and U.S. Pat. No. 4,130,418.

The casting temperature should be as low as practically possible and will vary with the composition and actual type of casting, between 1390° C. and 1460° C.

A conventional heat treatment process should normally be applied with an austenizing temperature of about 1050° to about 1150° C., depending upon exact composition and amount of remaining globular carbides that are wanted in the structure. For certain applications this type of alloy may even be used in the as cast condition.

As compared to the time consuming and costly prescribed heat treatment procedure for the previously known 12% Mn, 2% Mo austenitic steels, necessary to obtain the desired finely despersed carbide distribution for such steels, this new steel represents a major advantage.

Having described our invention, we claim:

1. An austenitic wear resistant steel having good wear resistance and serviceability when subjected to abrasive and combined abrasive stresses and impact stresses consisting essentially of, in percentage by weight:

| | |
|---|---|
| 16.–25. | Mn |
| 1.0–2.0 | C |
| 0.5–5.0 | Cr |
| 0.2–2.0 | Si |
| 0.1–0.5 | Ti |
| 0.3–4.0 | Mo |
| 0.0–0.5 | one or more of Ce, Sn, V, W or Nb (Cb) |
| 0.0–5.0 | Ni |
| 0.0–5.0 | Cu |
| 0.0–0.1 | P (impurity) |
| 0.0–0.1 | S (impurity) |
| remainder to 100% | Fe. |

2. The austenitic wear resistant steel of claim 1 consisting essentially of, in percentage by weight:

| | |
|---|---|
| 19.0–19.6 | Mn |
| 1.6–1.9 | C |
| 2.3–3.6 | Cr |
| 0.43–0.65 | Si |
| 0.1–0.3 | Ti |
| 1.1–2.7 | Mo |
| 0.0–0.1 | P (impurity) |
| 0.0–0.1 | S (impurity) |

-continued

| | |
|---|---|
| remainder to 100% | Fe. |

3. The austenitic wear resistant steel of claim 2, consisting essentially of, by weight:

| | |
|---|---|
| 19.5% | Mn |
| 1.6% | C |
| 2.3% | Cr |
| 0.51% | Si |
| 0.3% | Ti |
| 2.0% | Mo, |

the remainder being Fe and impurities.

4. The austenitic wear resistant steel of claim 2, consisting essentially of, by weight:

| | |
|---|---|
| 19.2% | Mn |
| 1.8% | C |
| 2.3% | Cr |
| 0.51% | Si |
| 0.3% | Ti |
| 2.0% | Mo, |

the remainder being Fe and impurities.

5. The austenitic wear resistant steel of claim 2, consisting essentially of, by weight:

| | |
|---|---|
| 19.5% | Mn |
| 1.8% | C |
| 3.5% | Cr |
| 0.48% | Si |
| 0.1% | Ti |
| 2.7% | Mo, |

the remainder being Fe and impurities.

6. The austenitic wear resistant steel of claim 2, consisting essentially of, by weight:

| | |
|---|---|
| 19.4% | Mn |
| 1.6% | C |
| 1.3% | Cr |
| 0.65% | Si |
| 0.1% | Ti |
| 1.1% | Mo, |

the remainder being Fe and impurities.

7. The austenitic wear resistant steel of claim 2, consisting essentially of, by weight:

| | |
|---|---|
| 19.6% | Mn |
| 1.6% | C |
| 2.3% | Cr |
| 0.51% | Si |
| 0.3% | Ti |
| 1.7% | Mo, |

the remainder being Fe and impurities.

8. The austenitic wear resistant steel of claim 2, consisting essentially of, by weight:

| | |
|---|---|
| 19.2% | Mn |
| 1.8% | C |
| 2.3% | Cr |
| 0.51% | Si |
| 0.2% | Ti |

-continued

| | |
|---|---|
| 2.0% | Mo, |

the remainder being Fe and impurities.

9. The austenitic wear resistant steel of claim 2, consisting essentially of, by weight:

| | |
|---|---|
| 19.0% | Mn |
| 1.9% | C |
| 3.6% | Cr |
| 0.43% | Si |
| 0.1% | Ti |
| 2.7% | Mo, |

the remainder being Fe and impurities.

* * * * *